US005924553A

United States Patent [19]

Yeh

[11] Patent Number: 5,924,553

[45] Date of Patent: Jul. 20, 1999

[54] KEYSWITCH ASSEMBLY

[75] Inventor: Ghi Pin Yeh, Tainan Hsien, Taiwan

[73] Assignee: Acer Peripherals, Inc., Taiwan

[21] Appl. No.: 09/170,047

[22] Filed: Oct. 13, 1998

[30] Foreign Application Priority Data

May 13, 1998 [TW] Taiwan ..... 87207435

[51] Int. Cl.[6] ..... H01H 3/12; H01H 13/70

[52] U.S. Cl. ..... 200/344; 200/5 A; 200/345

[58] Field of Search ..... 200/5 A, 517, 200/341, 344, 345; 400/490, 491, 491.2, 495, 495.1, 496

[56] References Cited

U.S. PATENT DOCUMENTS 5,457,297 10/1995 Chen ..... 200/344
5,512,719 4/1996 Okada et al. ..... 200/344
5,746,308 5/1998 Lin ..... 200/344
5,763,842 6/1998 Tsai et al. ..... 200/5 A
5,779,030 7/1998 Ikegami et al. ..... 200/344
5,799,772 9/1998 Sanda et al. ..... 200/344

*Primary Examiner*—Michael A. Friedhofer
*Attorney, Agent, or Firm*—Pillsbury Madison & Sutro LLP

[57] ABSTRACT

A keyswitch assembly suitable for being disposed on a computer keyboard that can prevent wobbling of its key cap when the key cap is at its elevated position. The keyswitch comprises a key cap capable of being urged to move between an elevated position and a pressed down position; a first connecting member connected to the cap and the substrate; a second connecting member connected to the cap and the substrate; and an elastic member disposed between the substrate and the key cap in such a way that it always urges the cap toward its first position. A positioning slot and a positioning pin or a guide slot and a protrusion formed on one connecting member are provided for keeping the cap from wobbling at its elevated position.

16 Claims, 12 Drawing Sheets

KEYSWITCH ASSEMBLY

BACKGROUND OF THE INVENTION

1. Field of the Invention

This invention relates to a keyswitch assembly suitable for being disposed on a keyboard. In particular, this invention relates to a keyswitch assembly capable of preventing wobbling of the key during its operation.

2. Description of Prior Art

These days, computers have become indispensable implements for daily life. Due to their high efficiency in data processing and data storage, computers are widely adopted in industry, commerce and the home. Likewise, computers are accessible to families and schools and bring convenience to people.

As to the input device of a computer, a keyboard is by far the most prevalent. The established mode of inputting data into computers with the aid of a keyboard is a succession from the manipulation of typewriters. In spite of the appearance of other tools and methods, the keyboard remains the dominant input device for computers.

FIG. 1 is a perspective exploded view showing the structure of a conventional keyswitch assembly. FIG. 2 is a perspective view, observed from the bottom thereof, showing the structure of the cap of the keyswitch assembly shown in FIG. 1. FIG. 3 is a side view showing a fabricated keyswitch assembly, wherein the cap of the keyswitch assembly is at its first (elevated) position. FIG. 4 is a side view showing the fabricated keyswitch assembly of FIG. 3, wherein the cap of the keyswitch assembly is at its second (pressed down) position.

As shown in FIGS. 1 to 4, the conventional keyswitch assembly comprises a substrate 10, a cap 12, a first connecting member 14, a second connecting member 16 and an elastic member 18. A film circuit board 11 is disposed onto the substrate 10, and two pivot supports 102 having through holes therein and an engaging hook 104 are formed on the substrate 10. The two pivot supports 102 are used for pivotally supporting the first connecting member 14 at its protrusions 142; the engaging hook 104 is used for engaging the second connecting member 16 at its rod-shaped member 164.

In fabricated state, the cap 12 is restrained to move only between the first (elevated) position (see FIG. 3) and the second (pressed down) position (see FIG. 4). As shown in FIG. 2, two through holes 122 for engaging with the rod-shaped member 162 of the second connecting member 16 and two hooks 124 for receiving the protrusions 144 of the first connecting member 14 are respectively formed on the bottom of the cap 12.

The first connecting member 14 is substantially in a "U" shape and two pairs of protrusions 142, 144 are respectively formed at its two sidewalls. As shown in FIG. 3, the protrusions 142 are pivotally disposed within the holes of the pivot supports 102, while the protrusions 144 are received within the hooks 124 of the cap 12. Furthermore, one pair of pivoting holes 146 are formed in the sidewalls of the first connecting member 14 (see FIG. 1), for accommodating the protrusions 166 of the second connecting member 16.

The second connecting member 16 is shaped like a rectangular frame; a first rod 162 and a second rod 164 are respectively formed at its two opposite ends. When assembled, the first rod 162 is accommodated within the two through holes 122 of the cap 12 and the second rod 164 is engaged with the engaging hook 104 (see FIG. 3). Furthermore, the protrusions 166 are fitted within the pivoting holes 146 of the first connecting member 14. The elastic member 18 made of rubber is disposed between the substrate 10 and the cap 12 in such a way that it always urges the cap 12 upward to keep the cap 12 at its first (elevated) position (see FIG. 3). At the time the cap 12 is pressed down (see FIG. 4), the elastic member 18 is guided to touch the film circuit board 11. When the elastic member 18 touches the film circuit board 11, the film circuit board 11 is switched into conducting state.

In the above conventional keyswitch assembly, to reduce the wavering of the cap 12 during its upward or downward movement, the clearance between the hooks 124 of the cap 12 and the protrusions 144 of the first connecting member 14 is kept small. However, this will induce interference between the hooks 124 and the first connecting member 14 during operation. In the worst case, the movement of the cap 12 gets jammed. In light of the above, the clearance between the hooks 124 of the cap 12 and the protrusions 144 of the first connecting member 14 is allowed to have a large value, which will intensify the wavering of the cap 12 during its operation. The same situation occurs to the engaging hook 104 and the second rod 164 of the second connecting member 16.

SUMMARY OF THE INVENTION

To solve the above problem, the primary object of this invention is to provide a keyswitch assembly suitable for being disposed on a substrate, which comprises a cap capable of being urged to move between a first position which is elevated from the substrate and a second position which is on the substrate; a first connecting member having a first end portion slidably connected to the cap, a second end portion pivotally connected to the substrate, and a first middle portion connecting the first end portion and the second end portion; a second connecting member having a third end portion pivotally connected to the cap, a fourth end portion slidably connected to the substrate, and a second middle portion connecting the third end portion and the fourth end portion, the second connecting member being pivotally connected with the first connecting member at their first and second middle portions; and an elastic member disposed between the substrate and the cap in such a way that it always urges the cap toward its first position, characterized in that: an engaging pin is formed on the cap and an engaging slot for engaging with the engaging pin is formed in the first connecting member, whereby the cap is out of wobbling at its first position.

Furthermore, the keyswitch assembly according to this invention is characterized in that: a positioning pin is formed on the first connecting member, and a positioning slot used for engaging with the positioning pin is formed on the bottom of the cap, whereby the cap is out of wobbling at its first position.

Furthermore, the keyswitch assembly according to this invention is characterized in that: two guide slots constructing a tapered guide way are formed on the bottom of the cap and the first end portion of the first connecting member is held by the tapered guide way of the two guide slots, whereby the cap is out of wobbling at its first position.

In the keyswitch assembly according to this invention, the substrate is provided with two pivot supports respectively having a hole therein for pivotally connecting the second end portion of the first connecting member and two engaging hooks for engaging the fourth end portion of the second connecting member, and the cap is provided with two through holes for pivotally connecting with the third end portion of the second connecting member and two hooks for pivotally connecting the first end portion of the first connecting member.

Furthermore, in the keyswitch assembly according to this invention, the openings of the engaging hooks converge in the same direction the fourth end portion of the second connecting member moves when the cap shifts from its second position toward its first position.

Furthermore, in the keyswitch assembly according to this invention, the openings of the engaging hooks are in a tapered shape.

Furthermore, in the keyswitch assembly according to this invention, a circuit board is provided on the substrate.

Furthermore, in the keyswitch assembly according to this invention, the openings of the guide slots are in a tapered shape.

Furthermore, in the keyswitch assembly according to this invention, the free end of the first end portion of the first connecting member is chamfered.

BRIEF DESCRIPTION OF THE DRAWINGS

The present invention can be more fully understood by reading the subsequent detailed description and examples with reference made to accompanying drawings, wherein.

DETAILED DESCRIPTION OF THE PREFERRED EMBODIMENTS

First Embodiment

Figure 1:
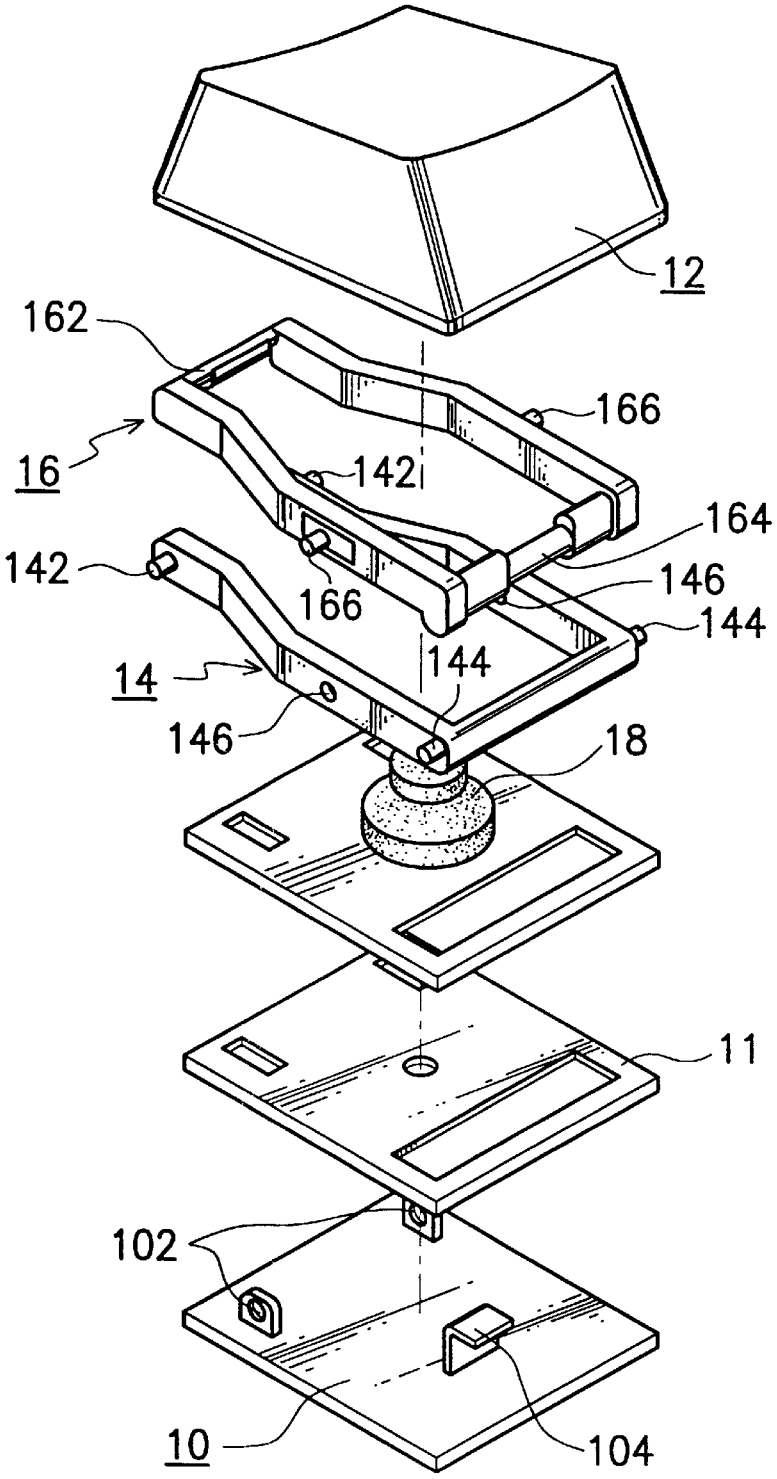
FIG. 1 (PRIOR ART)
FIG. 1 is a perspective exploded view showing the structure of a conventional keyswitch assembly.
Figure 2:
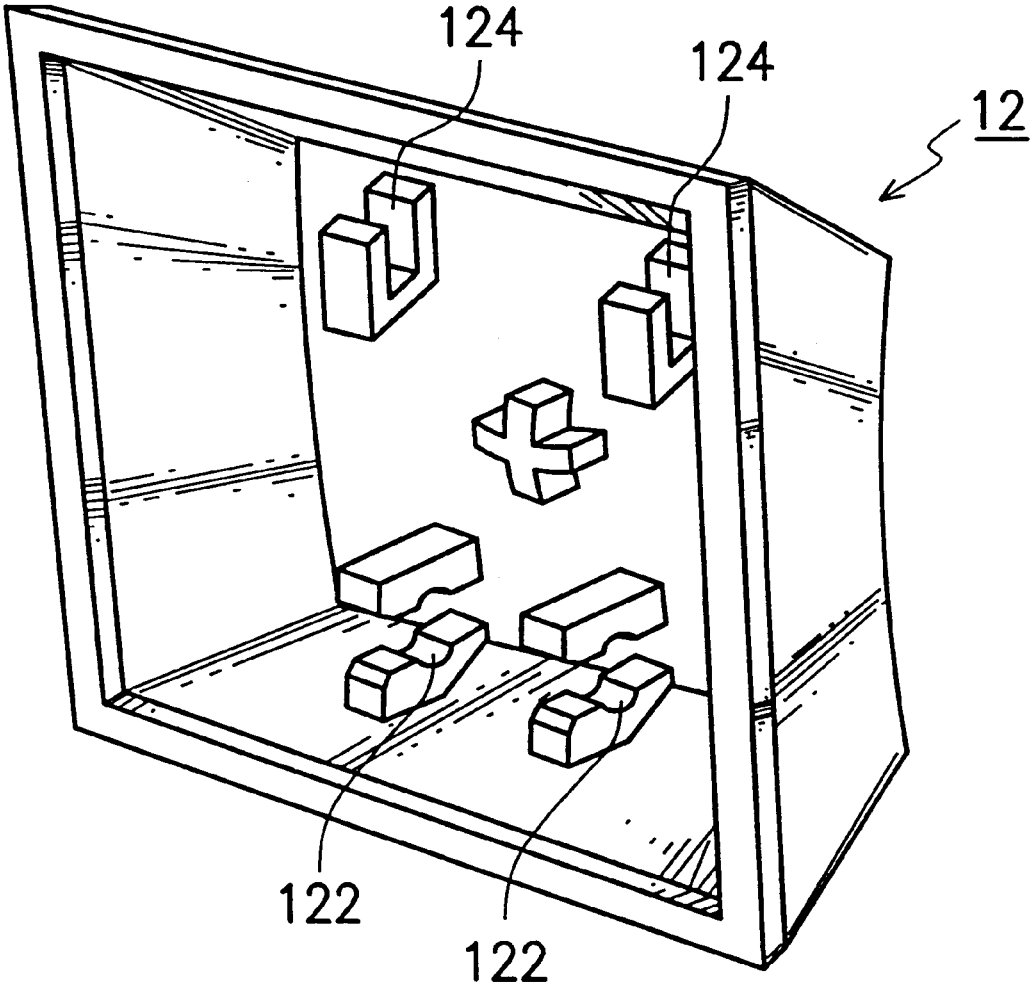
FIG. 2 (PRIOR ART)
FIG. 2 is a perspective view, observed from the bottom thereof, showing the structure of the cap of the keyswitch assembly shown in FIG. 1.
Figure 3:
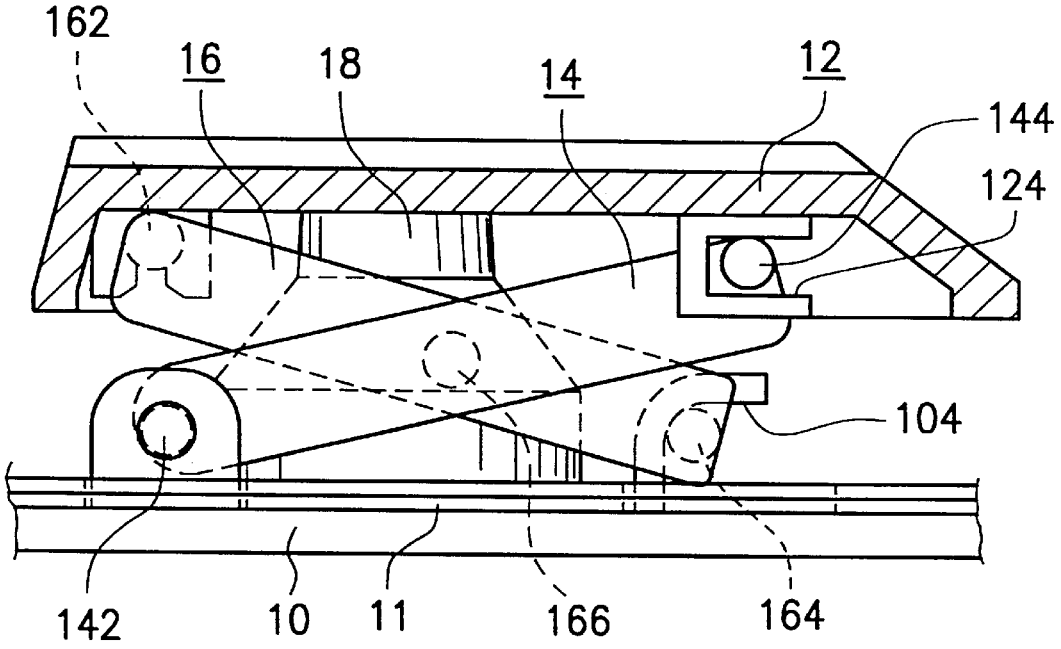
FIG. 3 (PRIOR ART)
FIG. 3 is a side view showing a fabricated keyswitch assembly, wherein the cap of the keyswitch assembly is at its first (elevated) position.
Figure 4:
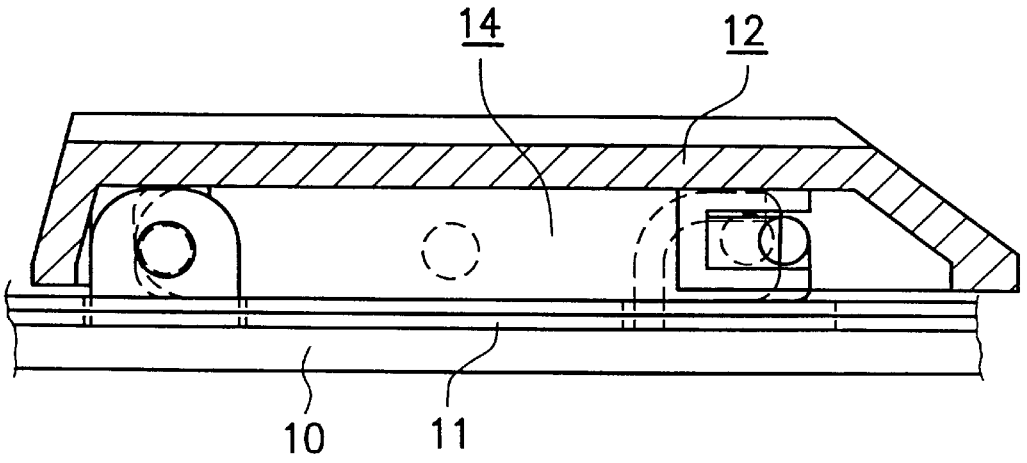
FIG. 4 (PRIOR ART)
FIG. 4 is a side view showing the fabricated keyswitch assembly of FIG. 3, wherein the cap of the keyswitch assembly is at its second (pressed down) position.
Figure 5:
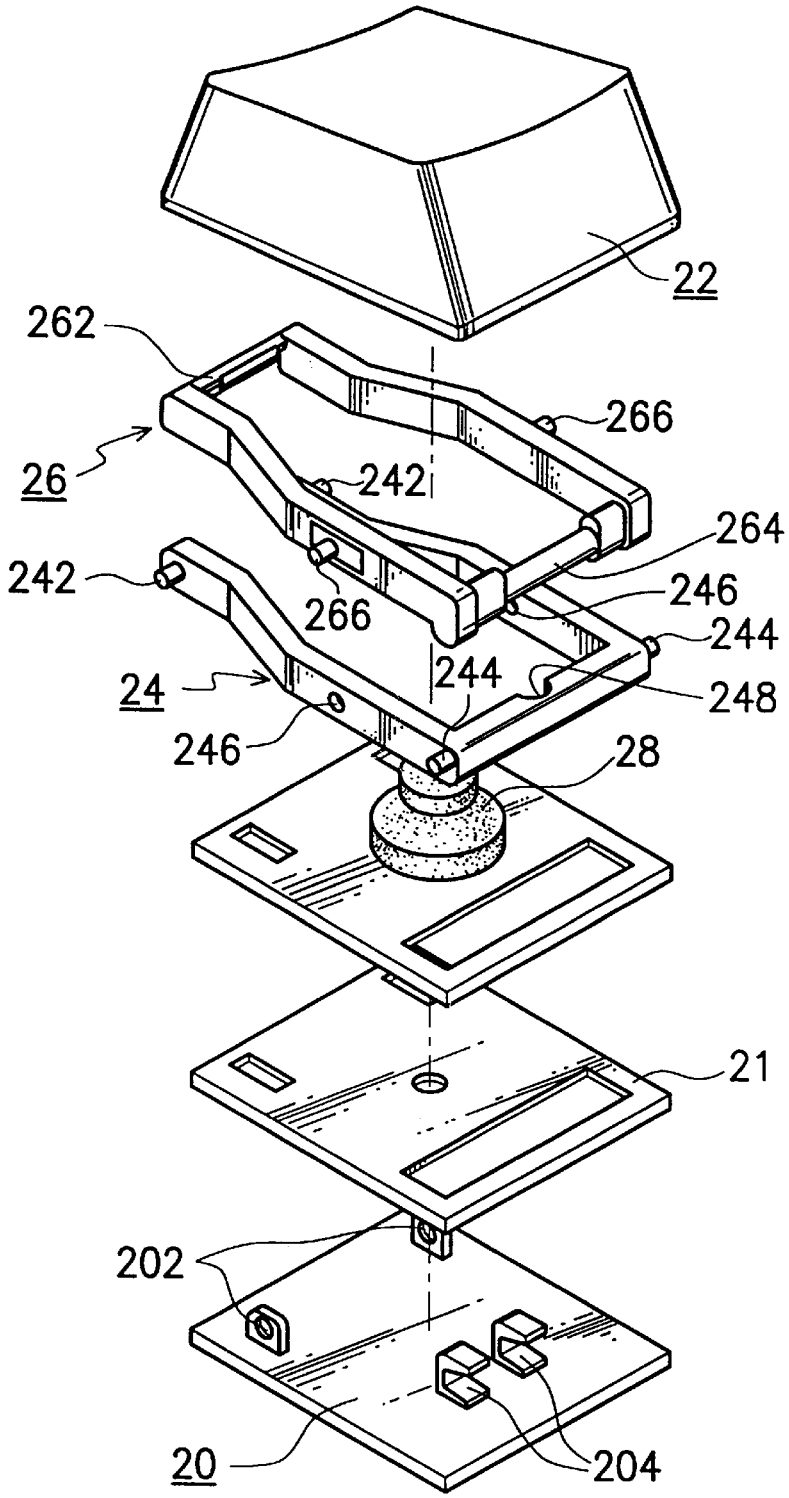
FIG. 5 is a perspective exploded view showing the structure of the first embodiment of the keyswitch assembly according to this invention.
Figure 6:
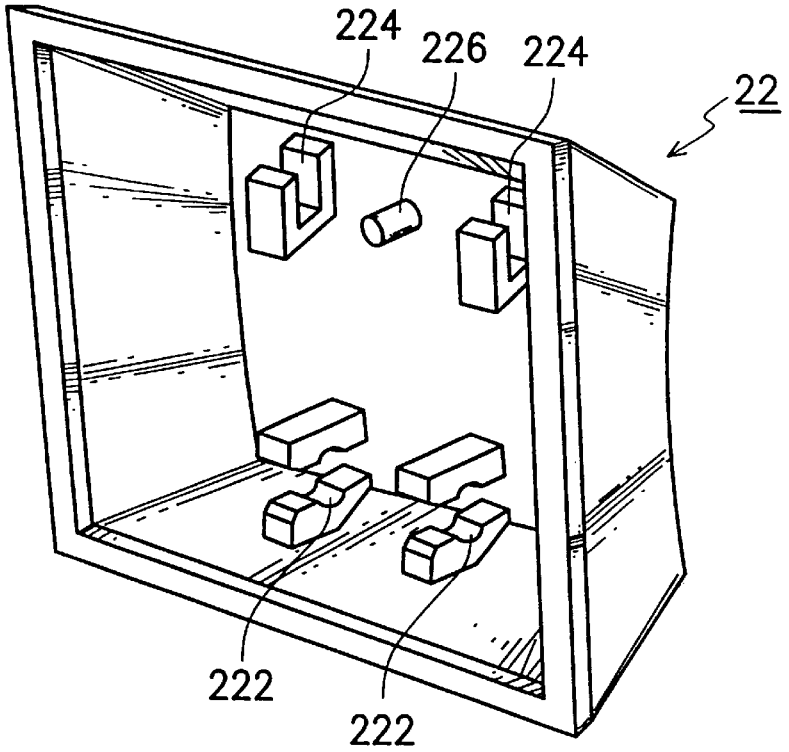
FIG. 6 is a perspective view, observed from the bottom thereof, showing the structure of the cap of the keyswitch assembly shown in FIG. 5.
Figure 7:
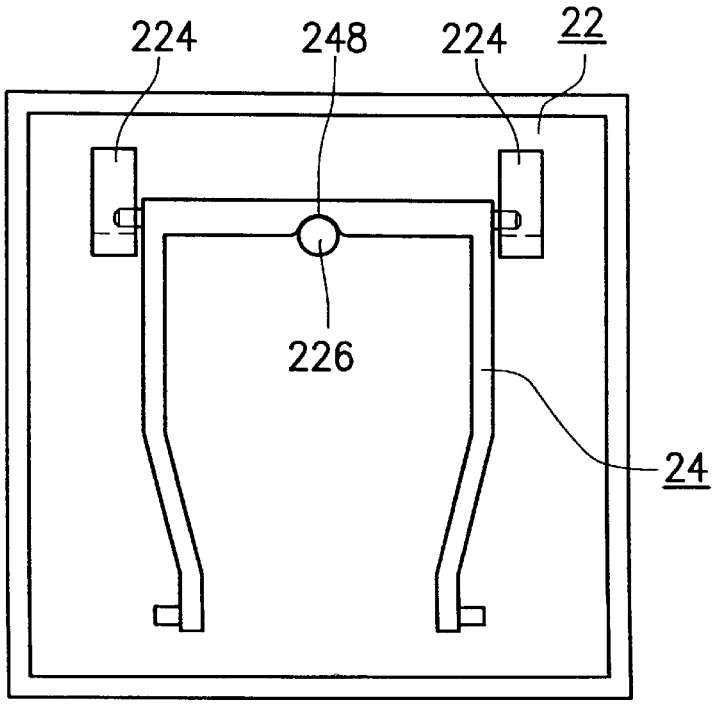
FIG. 7 is a bottom view showing the fabricated keyswitch assembly of FIG. 5, wherein the cap of the keyswitch assembly is at its first (elevated) position.
Figure 8:
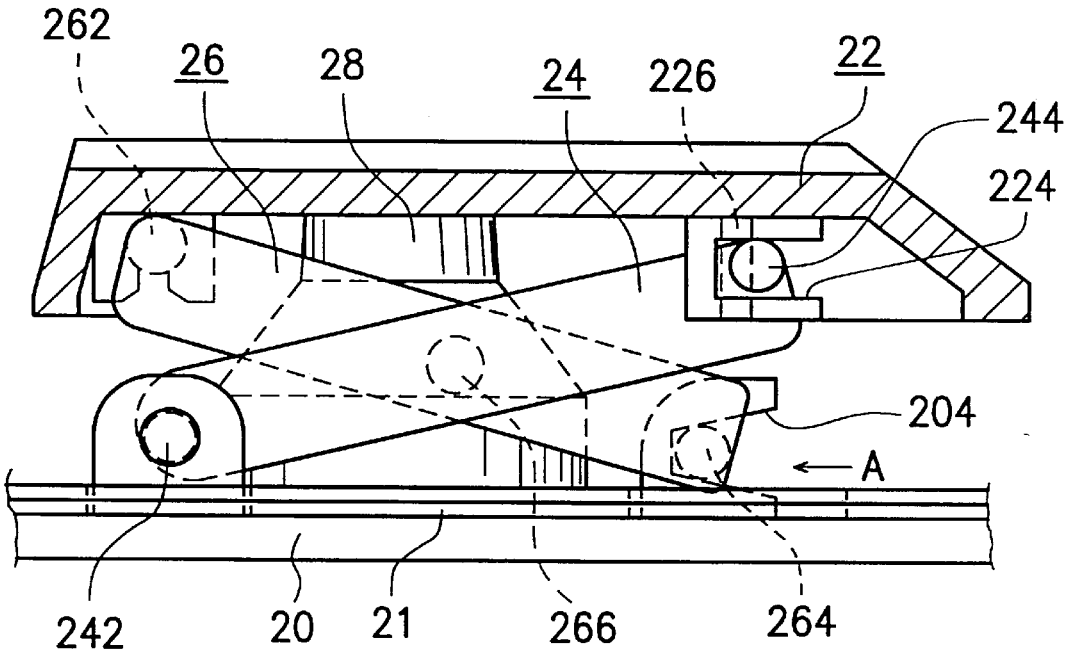
FIG. 8 is a side view showing a fabricated keyswitch assembly of FIG. 5, wherein the cap of the keyswitch assembly is at its first (elevated) position.
Figure 9:
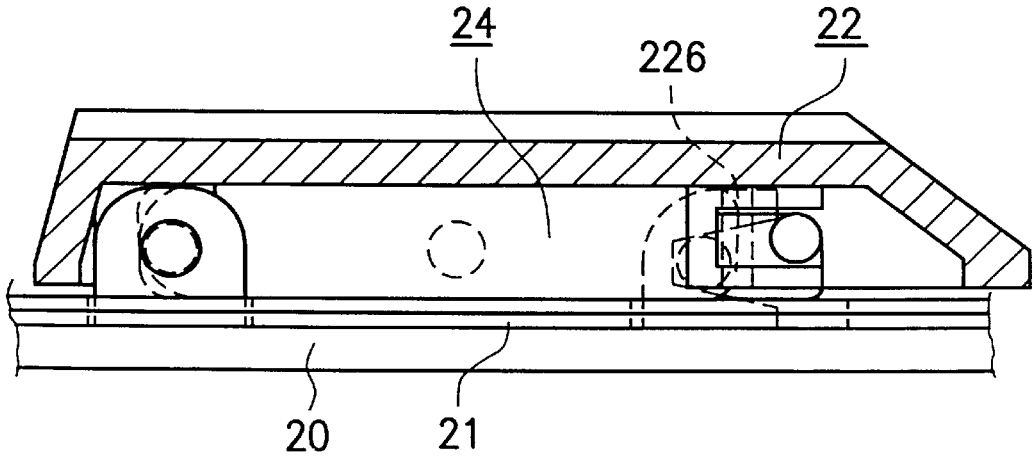
FIG. 9 is a side view showing the fabricated keyswitch assembly of FIG. 5, wherein the cap of the keyswitch assembly is at its second (pressed down) position.

FIG. 5 is a perspective exploded view showing the structure of the first embodiment of the keyswitch assembly according to this invention. FIG. 6 is a perspective view, observed from the bottom thereof, showing the structure of the cap of the keyswitch assembly shown in FIG. 5. FIG. 7 is a bottom view showing the fabricated keyswitch assembly of FIG. 5, wherein the cap of the keyswitch assembly is at its first (elevated) position. FIG. 8 is a side view showing a fabricated keyswitch assembly of FIG. 5, wherein the cap of the keyswitch assembly is at its first (elevated) position. FIG. 9 is a side view showing the fabricated keyswitch assembly of FIG. 5, wherein the cap of the keyswitch assembly is at its second (pressed down) position. As shown in FIGS. 5 to 9, the keyswitch assembly of the first embodiment according to this invention comprises a substrate 20, a cap 22, a first connecting member 24, a second connecting member 26 and an elastic member 28. A film circuit board 21 is disposed onto the substrate 20, and two pivot supports 202 having through holes therein and two engaging hooks 204 are formed on the substrate 20. The two pivot supports 202 are used for pivotally supporting the first connecting member 24 at its protrusions 242; two engaging hooks 204 are used for engaging the second connecting member 26 at its rod-shaped member 264.

In an assembled state, the cap 22 is restrained to move only between the first (elevated) position (see FIG. 8) and the second (pressed down) position (see FIG. 9). As shown in FIG. 6, two through holes 222 for engaging with the rod-shaped member 262 of the second connecting member 26 and two hooks 224 for receiving the protrusions 244 of the first connecting member 24 are respectively formed on the bottom of the cap 22. Furthermore, an engaging pin 226 for engaging with the first connecting member 24 is formed on the bottom of the cap 22 (see FIG. 7).

The first connecting member 24 can be in the shape of a "U", a rectangular frame or others. In this embodiment, the first connecting member 24 is in a "U" shape and two pairs of protrusions 242, 244 are respectively formed at its two sidewalls. As shown in FIG. 8, the protrusions 242 are pivotally disposed within the holes of the pivot supports 202, while the protrusions 244 are received within the hooks 224 of the cap 22. Furthermore, one pair of pivoting holes 246 are formed in the sidewalls of the first connecting member 24 (see FIG. 5), for accommodating the protrusions 266 of the second connecting member 26. Furthermore, an engaging slot 248 for engaging with the engaging pin 226 is formed in the first connecting member 24.

The second connecting member 26 can be in the shape of a "U", a rectangular frame or others. In this embodiment, the second connecting member 26 is shaped like a rectangular frame. A first rod 262 and a second rod 264 are respectively formed at its two opposite ends. When assembled, the first rod 262 is accommodated within the two through holes 222 of the cap 22 and the second rod 264 is engaged with the engaging hooks 204 (see FIG. 8). Furthermore, to pivotally connect the first connecting member 24 and the second connecting member 26, protrusions or pivoting holes can be formed on the first connecting member 24 and the second connecting member 26. In this embodiment, protrusions 266 are formed on the second connecting member 26 and pivoting holes 246 are formed on the first connecting member 24. The protrusions 266 fitted within the pivoting holes 246 of the first connecting member 24. Furthermore, the openings of the engaging hooks 204 are in a tapered shape. Specifically, the widths of the openings of the engaging hooks 204 become smaller and smaller in the "A" direction. When the cap 22 is released from its second (pressed down) position to its first (elevated) position (see FIGS. 8 and 9), the second rod 264 will move in the "A" direction and will be firmly held by the engaging hooks 204. By this arrangement, the cap 12 can be out of wobbling at its first (elevated) position.

The elastic member 28 made of rubber is disposed between the substrate 20 and the cap 22 in such a way that it always urges the cap 22 upward to keep the cap 12 at its first (elevated) position (see FIG. 8). At the time the cap 12 is pressed down (see FIG. 9), the elastic member 28 is guided to touch the film circuit board 21. When the elastic member 28 touches the film circuit board 21, the film circuit board 21 is switched into a conducting state.

Second Embodiment

Figure 10:
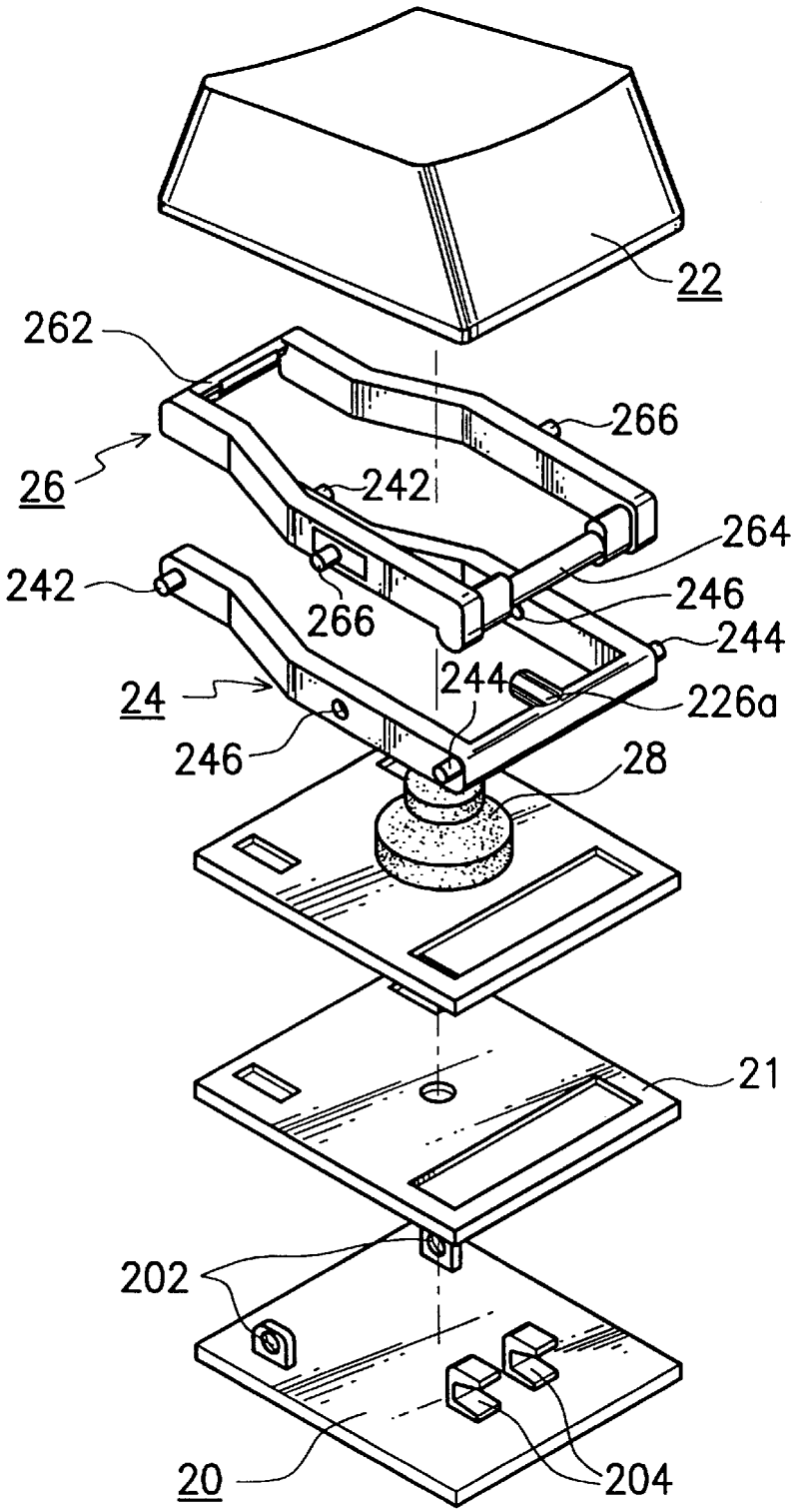
FIG. 10 is a perspective exploded view showing the structure of the second embodiment of the keyswitch assembly according to this invention.
Figure 11:
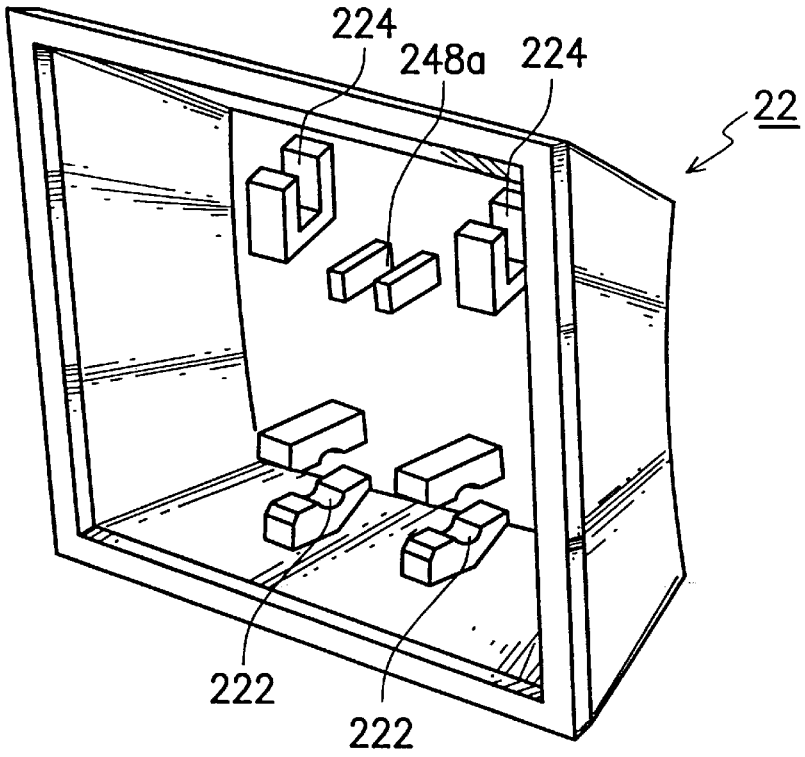
FIG. 11 is a perspective view, observed from the bottom thereof, showing the structure of the cap of the keyswitch assembly shown in FIG. 10.
Figure 12:
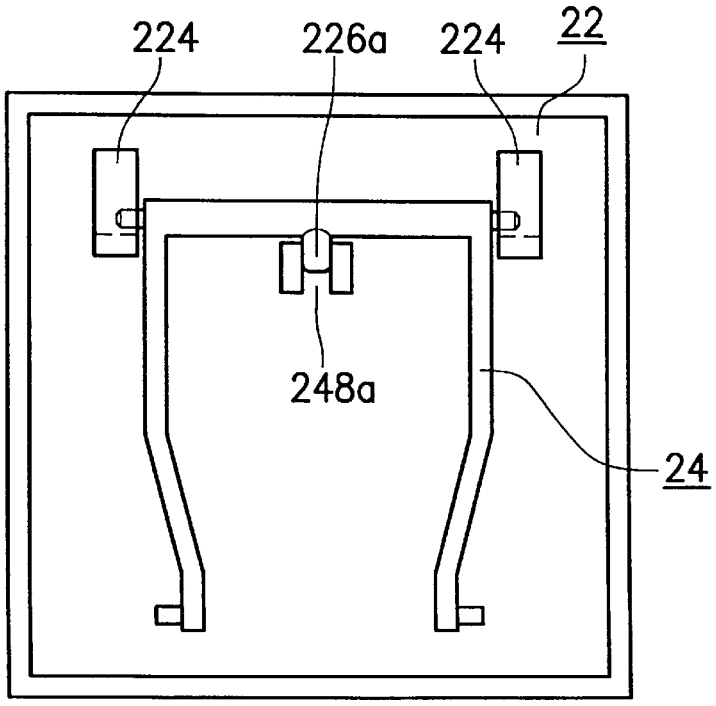
FIG. 12 is a bottom view showing the fabricated keyswitch assembly of FIG. 10, wherein the cap of the keyswitch assembly is at its first (elevated) position.
Figure 13:
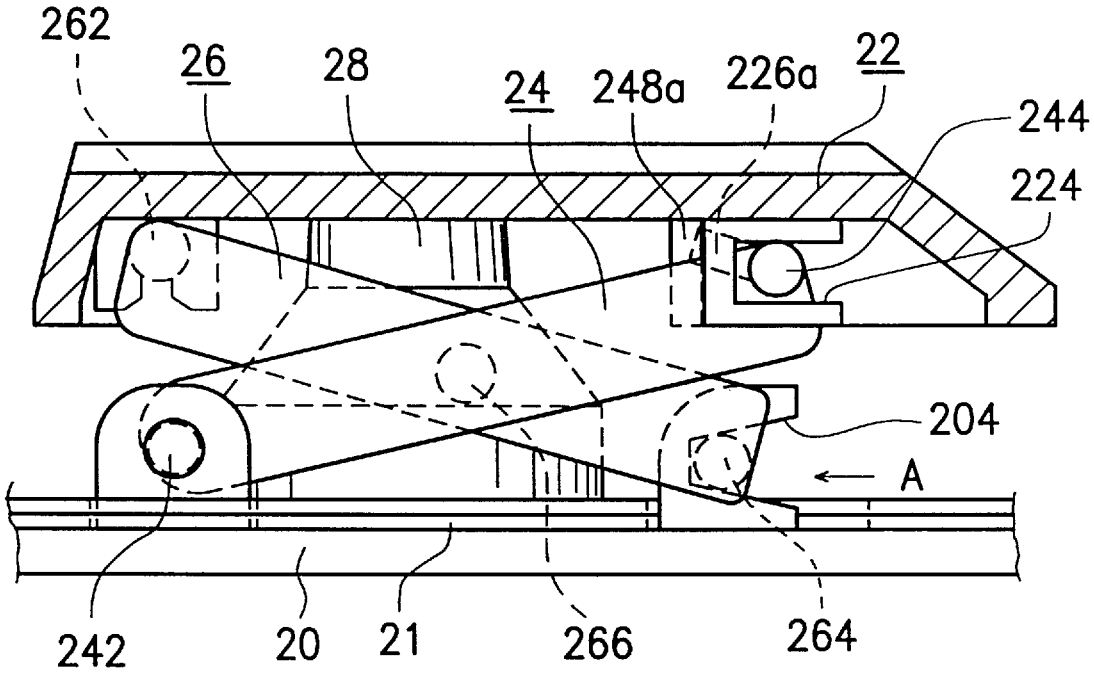
FIG. 13 is a side view showing a fabricated keyswitch assembly of FIG. 10, wherein the cap of the keyswitch assembly is at its first (elevated) position.
Figure 14:
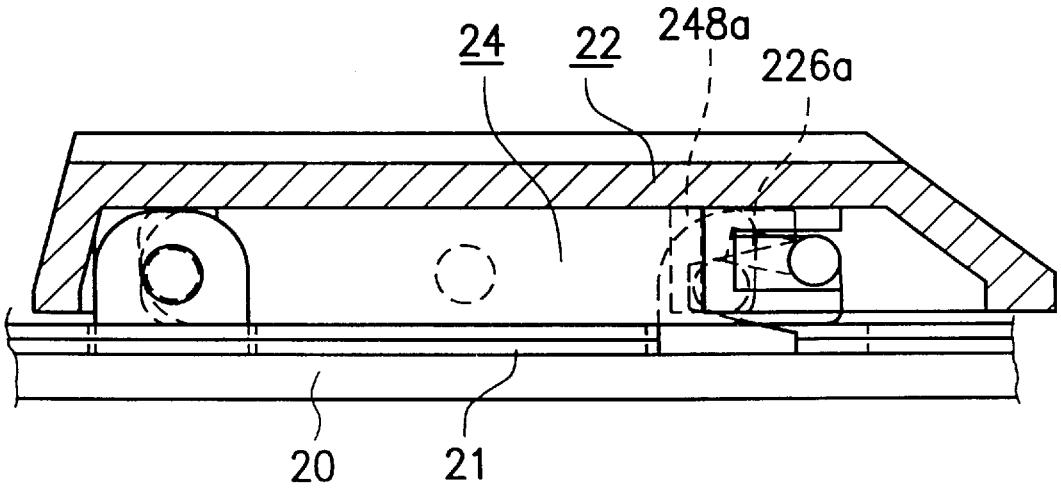
FIG. 14 is a side view showing the fabricated keyswitch assembly of FIG. 10, wherein the cap of the keyswitch assembly is at its second (pressed down) position.

FIG. 10 is a perspective exploded view showing the structure of the second embodiment of the keyswitch assembly according to this invention. FIG. 11 is a perspective view, observed from the bottom thereof, showing the structure of the cap of the keyswitch assembly shown in FIG. 10. FIG. 12 is a bottom view showing the fabricated keyswitch assembly of FIG. 10, wherein the cap of the keyswitch assembly is at its first (elevated) position. FIG. 13 is a side view showing a fabricated keyswitch assembly of FIG. 10, wherein the cap of the keyswitch assembly is at its first (elevated) position. FIG. 14 is a side view showing the fabricated keyswitch assembly of FIG. 10, wherein the cap of the keyswitch assembly is at its second (pressed down) position. The members shown in FIGS. 10 to 14 with same functions and structures as those shown in FIGS. 5 to 9 are indicated by same or similar numerals, and their description is omitted.

The difference between the keyswitch assembly of the second embodiment and the keyswitch assembly of the first embodiment resides in that a positioning pin 226*a* is formed on the first connecting member 24 of the second embodiment. In addition, a positioning slot 248*a* used for engaging with the positioning pin 226*a* is formed on the bottom of the cap 22 (see FIGS. 11 and 12). By this arrangement, the cap 22 can be out of wobbling at its first (elevated) position. In the first embodiment, the engaging slot 248 of the first connecting member 24 is used to engage with the engaging pin 226 of the cap 22 to prevent the wobbling of the cap 22 at its first (elevated) position. Therefore, the same functions can be achieved in both embodiments.

Third Embodiment

Figure 15:
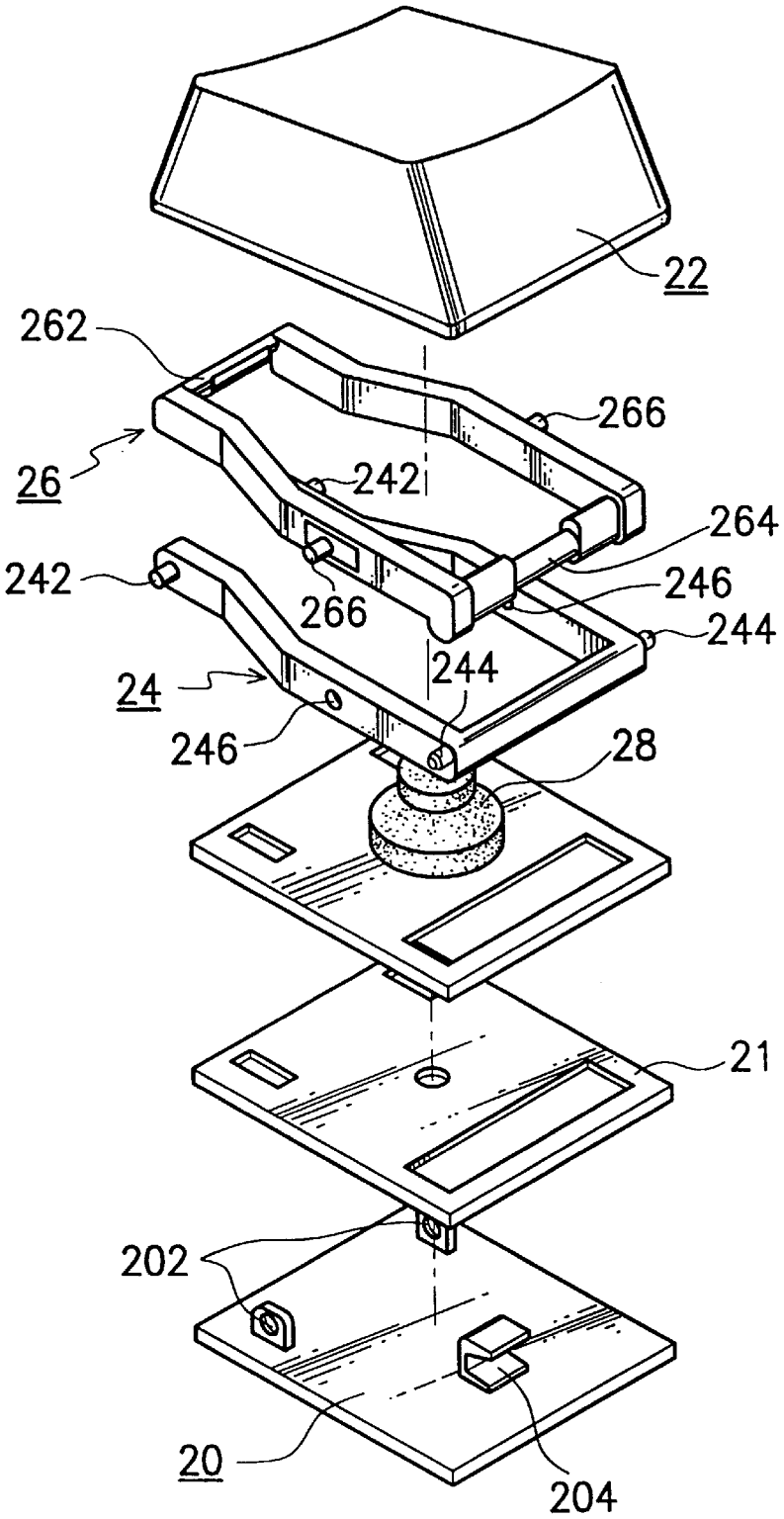
FIG. 15 is a perspective exploded view showing the structure of the third embodiment of the keyswitch assembly according to this invention.
Figure 16:
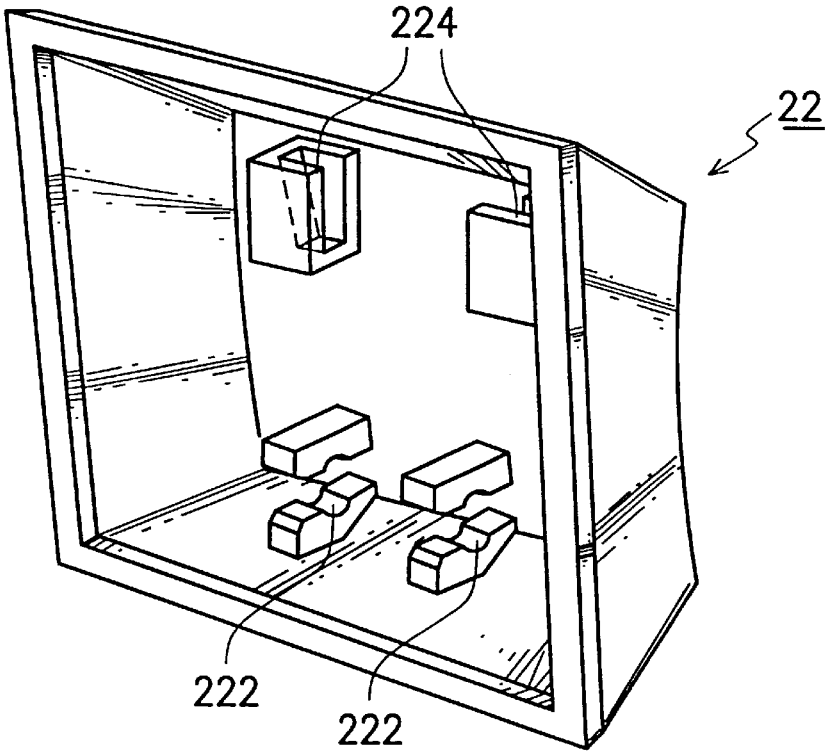
FIG. 16 is a perspective view, observed from the bottom thereof, showing the structure of the cap of the keyswitch assembly shown in FIG. 15.
Figure 17:
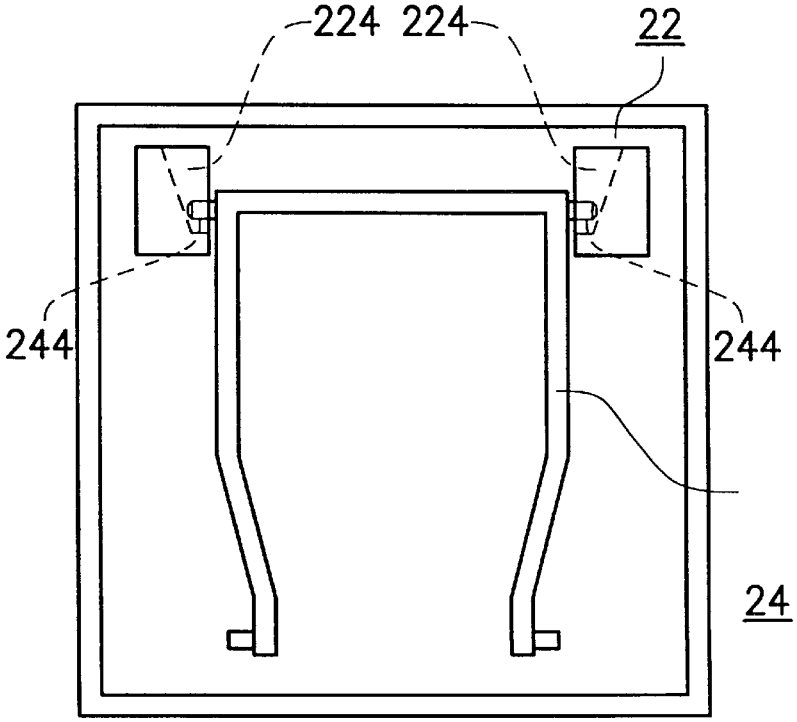
FIG. 17 is a bottom view showing the fabricated keyswitch assembly of FIG. 15, wherein the cap of the keyswitch assembly is at its first (elevated) position.
Figure 18:
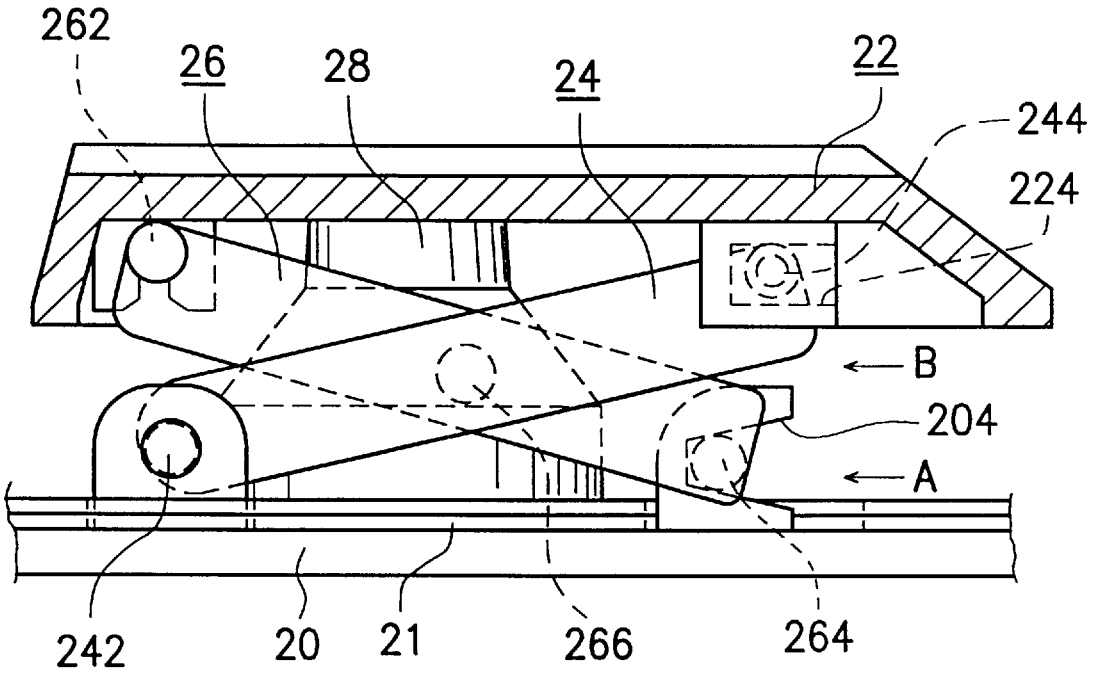
FIG. 18 is a side view showing a fabricated keyswitch assembly of FIG. 15, wherein the cap of the keyswitch assembly is at its first (elevated) position.
Figure 19:
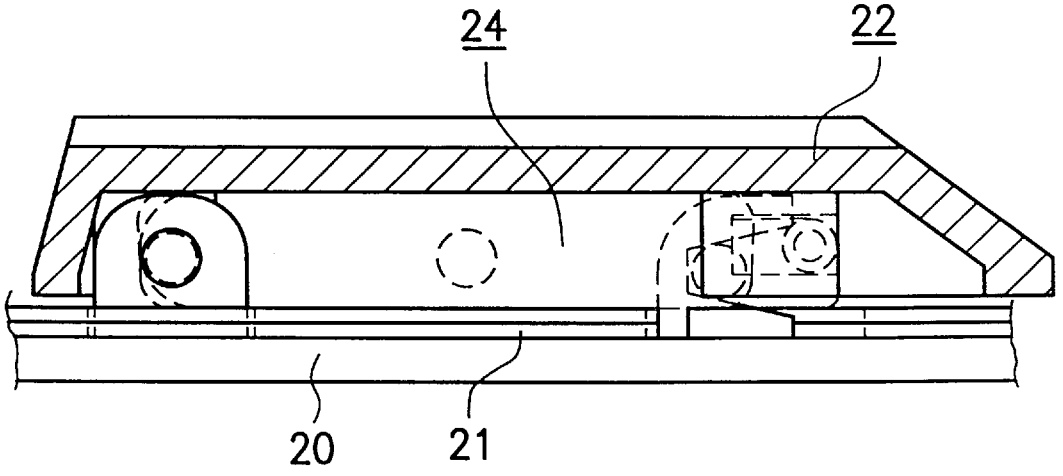
FIG. 19 is a side view showing the fabricated keyswitch assembly of FIG. 15, wherein the cap of the keyswitch assembly is at its second (pressed down) position.

FIG. 15 is a perspective exploded view showing the structure of the third embodiment of the keyswitch assembly according to this invention. FIG. 16 is a perspective view, observed from the bottom thereof, showing the structure of the cap of the keyswitch assembly shown in FIG. 15. FIG. 17 is a bottom view showing the fabricated keyswitch assembly of FIG. 15, wherein the cap of the keyswitch assembly is at its first (elevated) position. FIG. 18 is a side view showing a fabricated keyswitch assembly of FIG. 15, wherein the cap of the keyswitch assembly is at its first (elevated) position. FIG. 19 is a side view showing the fabricated keyswitch assembly of FIG. 15, wherein the cap of the keyswitch assembly is at its second (pressed down) position. The members shown in FIGS. 15 to 19 with same functions and structures as those shown in FIGS. 5 to 9 are indicated by same or similar numerals, and their description is omitted.

The difference between the keyswitch assembly of the third embodiment and the keyswitch assembly of the first embodiment resides in that neither an engaging slot 248 in the first connecting member 24 nor an engaging pin 226 on the cap 22 are formed. Instead, two guide slots 224 are formed on the bottom of the cap 22 (see FIG. 16). As shown in FIGS. 16 and 17, the two guide slots 224 form a tapered guide way whose narrow end is close to the center of the cap 22. The end faces of the protrusions 244 of the first connecting member 24 are chamfered (see FIGS. 15 and 17). By this arrangement, when the cap 22 is released from its second (pressed down) position to its first (elevated) position (see FIGS. 18 and 19), the protrusions 244 received within the guide way will move in the "B" direction of FIG. 18. In other words, the protrusions 244 move toward the narrow end of the tapered guide way of the two guide slots 224. Accordingly, the protrusions 244 are firmly held by the tapered guide way of the two guide slots 224. Therefore, the cap 22 can be out of wobbling at its first (elevated) position.

Other portions of the third embodiment are of the same structure to those of the first embodiment and the second embodiment. For example, the opening of engaging hook 204 is in a tapered shape. The width of the opening of the engaging hook 204 become smaller and smaller in the "A" direction of FIG. 18. When the cap 22 is released from its second (pressed down) position to its first (elevated) position, the second rod 264 will move in the "A" direction and will be firmly held by the engaging hook 204. If the second connecting member 26 is substantially in a "U" shape, two engaging hooks 204 (instead of one engaging hook 24 of FIG. 15) can be used. In this embodiment, the two guide slots 224 form a tapered guide way whose narrow end is close to the center of the cap 22. It is also acceptable to form two parallel guide hooks (not shown) on the bottom of the cap 22, instead of the two guide slots 224. The two guide hooks have a shape similar to that of the engaging hooks 204. In a similar manner, the narrow ends of the tapered openings of the two guide hooks are disposed near the center of the cap 22. By this arrangement, when the cap 22 is released from its second (pressed down) position to its first (elevated) position, the protrusions 244 received within the guide hooks will move in the "B" direction of FIG. 18. Namely, the protrusions 244 move toward the narrow end of the tapered openings of the two guide hooks. The protrusions 244 could be firmly held by the two guide hooks, and the cap 22 could be out of wobbling at its first (elevated) position.

According to the first embodiment of the keyswitch assembly of this invention, an engaging pin is formed on the cap and an engaging slot for engaging with the engaging pin is formed in the first connecting member. Therefore, the cap can be out of wobbling at its first (elevated) position. In the second embodiment of the keyswitch assembly of this invention, a positioning pin is formed on the first connecting member, and a positioning slot used for engaging with the positioning pin is formed on the bottom of the cap. Therefore, the cap can be out of wobbling at its first (elevated) position. In the third embodiment of the keyswitch assembly of this invention, two guide slots are formed on the bottom of the cap. The two guide slots form a tapered guide way whose narrow end is close to the center of the cap. The protrusions of the first connecting member can be firmly held by the tapered guide way of the two guide slots. Therefore, the cap can be out of wobbling at its first (elevated) position.

Although this invention has been described with preferred embodiments, it is understood that the scope of the invention should be defined by the appended claims and not by the specific embodiments.

What is claimed is:

1. A keyswitch assembly suitable for being disposed on a substrate, which comprises a cap capable of being urged to move between a first position which is elevated from the substrate and a second position which is on the substrate; a first connecting member having a first end portion slidably connected to the cap, a second end portion connected to the substrate, and a first middle portion connecting the first end portion and the second end portion; a second connecting member having a third end portion connected to the cap, a fourth end portion connected to the substrate, and a second middle portion connecting the third end portion and the fourth end portion, the second connecting member being pivotally connected with the first connecting member at the first and second middle portions; and an elastic member disposed between the substrate and the cap in such a way that the elastic member always urges the cap toward the first position, characterized in that:

an engaging pin is formed on the cap and an engaging slot for engaging with the engaging pin is formed in the first connecting member, whereby the cap does not wobble at the first position.

2. A keyswitch assembly as claimed in claim 1, wherein the substrate is provided with two pivot supports respectively having a hole therein for pivotally connecting the second end portion of the first connecting member and two engaging hooks for engaging the fourth end portion of the second connecting member, and the cap is provided with two through holes for pivotally connecting with the third end portion of the second connecting member and two hooks for pivotally connecting the first end portion of the first connecting member.

3. A keyswitch assembly as claimed in claim 2, wherein the openings of the engaging hooks converge in the same direction the fourth end portion of the second connecting member moves when the cap shifts from the second position toward the first position.

4. A keyswitch assembly as claimed in claim 3, wherein the openings of the engaging hooks are in a tapered shape.

5. A keyswitch assembly as claimed in claim 4, wherein a circuit board is provided on the substrate.

6. A keyswitch assembly suitable for being disposed on a substrate, which comprises a cap capable of being urged to move between a first position which is elevated from the substrate and a second position which is on the substrate; a first connecting member having a first end portion slidably connected to the cap, a second end portion connected to the substrate, and a first middle portion connecting the first end portion and the second end portion; a second connecting member having a third end portion connected to the cap, a fourth end portion connected to the substrate, and a second middle portion connecting the third end portion and the fourth end portion, the second connecting member being pivotally connected with the first connecting member at the first and second middle portions; and an elastic member disposed between the substrate and the cap in such a way that the elastic member always urges the cap toward the first position, characterized in that:

a positioning pin is formed on the first connecting member, and a positioning slot used for engaging with the positioning pin is formed on a bottom of the cap, whereby the cap does not wobble at the first position.

7. A keyswitch assembly as claimed in claim 6, wherein the substrate is provided with two pivot supports respectively having a hole therein for pivotally connecting the second end portion of the first connecting member and two engaging hooks for engaging the fourth end portion of the second connecting member, and the cap is provided with two through holes for pivotally connecting with the third end portion of the second connecting member and two hooks for pivotally connecting the first end portion of the first connecting member.

8. A keyswitch assembly as claimed in claim 7, wherein the openings of the engaging hooks converge in the same direction the third end portion of the second connecting member moves when the cap shifts from the second position toward the first position.

9. A keyswitch assembly as claimed in claim 8, wherein the openings of the engaging hooks are in a tapered shape.

10. A keyswitch assembly as claimed in claim 9, wherein a circuit board is provided on the substrate.

11. A keyswitch assembly, which comprises a substrate having at least one pivot support and at least one engaging hook; a cap capable of being urged to move between a first position which is elevated from the substrate and a second position which is on the substrate, and provided with at least one through hole and at least one guide hook; a first connecting member having a first end portion slidably connected to the at least one guide hook, a second end portion connected to the at least one pivot support, and a first middle portion connecting the first end portion and the second end portion; a second connecting member having a third end portion connected to the at least one through hole, a fourth end portion connected to the at least one engaging hook, and a second middle portion connecting the third end portion and the fourth end portion, the second connecting member being pivotally connected with the first connecting member at the first and second middle portions; and an elastic member disposed between the substrate and the cap in such a way that the elastic member always urges the cap toward the first position, characterized in that:

the at least one guide hook forms a tapered guide way and is formed on a bottom of the cap and the first end portion of the first connecting member is held by the tapered guide way of the at least one guide hook, whereby the cap does not wobble at the first position.

12. A keyswitch assembly as claimed in claim 11, wherein an opening of the at least one engaging hook is in a tapered shape.

13. A keyswitch assembly as claimed in claim 12, wherein a free end of the first end portion of the first connecting member is chamfered.

14. A keyswitch assembly as claimed in claim 13, wherein the opening of the at least one engaging hook converges in the same direction the fourth end portion of the second connecting member moves when the cap shifts from the second position toward the first position.

15. A keyswitch assembly as claimed in claim 14, wherein the at least one engaging hook for engaging the fourth end portion of the second connecting member is formed on the substrate and the opening of the engaging hook is in a tapered shape.

16. A keyswitch assembly as claimed in claim 15, wherein a circuit board is provided on the substrate.

* * * * *